US005904030A

United States Patent [19]

Kavanagh

[11] Patent Number: 5,904,030

[45] Date of Patent: May 18, 1999

[54] PROCESS FOR MAKING AN ENVELOPE ASSEMBLY WITH FOLDED INSERT

[76] Inventor: Conor Kavanagh, Adelaide Road, Glenageary Co. Dublin, Ireland

[21] Appl. No.: 08/793,645

[22] PCT Filed: Sep. 5, 1995

[86] PCT No.: PCT/IE95/00045

§ 371 Date: Jun. 2, 1997

§ 102(e) Date: Jun. 2, 1997

[87] PCT Pub. No.: WO96/07544

PCT Pub. Date: Mar. 14, 1996

[30] Foreign Application Priority Data

Sep. 5, 1994 [IE] Ireland ..... S 940694

[51] Int. Cl.[6] ..... B42C 3/00; B42D 5/02; B65B 11/50

[52] U.S. Cl. ..... 53/460; 493/216; 493/921

[58] Field of Search ..... 53/460, 569, 284.3, 53/206; 493/216, 921; 229/69; 206/449

[56] References Cited

U.S. PATENT DOCUMENTS

| | | | |
|---|---|---|---|
| 3,337,120 | 8/1967 | Steidinger . | |
| 3,626,821 | 12/1971 | Gendron | 493/216 |
| 3,665,817 | 5/1972 | Katz et al. | 493/216 |
| 4,012,268 | 3/1977 | Johnsen | 156/200 |
| 4,769,969 | 9/1988 | Minami | 493/216 X |
| 4,931,035 | 6/1990 | Schmidt | 493/216 |
| 5,233,812 | 8/1993 | Coppola | 493/216 X |

FOREIGN PATENT DOCUMENTS

| | | |
|---|---|---|
| 0019703A1 | 12/1980 | European Pat. Off. . |
| 2676395 | 11/1992 | France . |

OTHER PUBLICATIONS

International Search Report for PCT/IE95/00045, Jan. 30, 1996.

*Primary Examiner*—James F. Coan
*Attorney, Agent, or Firm*—Bell Seltzer Intellectual Property Law Group of Alston & Bird LLP

[57] ABSTRACT

There is provided a separable multiple ply envelope assembly or mailer and process for making same having superimposed outerplies adhered together at their peripheral edges so as to form an envelope and including at least one extractible insert sheet formed from a respective inner ply, and a removable tear-off stub portion along at least one side or face of the assembly to which a corresponding side of the envelope and the insert are both attached, characterized in that the insert sheet is folded prior to its insertion between, and adherence together of the outer plies. Processes for constructing such an assembly are also disclosed.

4 Claims, 6 Drawing Sheets

PROCESS FOR MAKING AN ENVELOPE ASSEMBLY WITH FOLDED INSERT

TECHNICAL FIELD

The present invention relates to an envelope assembly including a folded insert, in particular to a separable multiple ply envelope assembly adapted for continuous computer printing of both outer and inner plies, commonly known as a mailer.

BACKGROUND ART

Free insert mailers are known, as for example described in my International Patent Application WO-A-9321022. In general, removal of a tear-off stub portion along one side of the mailer allows free withdrawal of the inner ply or plies which are not otherwise attached to the assembly. A basic free insert mailer may comprise front and back outer plies which comprise the envelope, and inner plies comprising for example business forms. Two inner plies may be superimposed and glued together to form a smaller return envelope. This is not a prefolded envelope but may comprise a foldable closure flap. The inner plies may for example be die cut or chipped on three sides so that glue lines running transverse of the web to join the outer plies do not attach the inner plies, which are normally glued longitudinally along a fourth side to attach to the stub portion.

It will be appreciated that the multiple ply assembly is constructed from a plurality of webs which are generally pre-printed and subjected to successive and various transverse and longitudinal chipping, glueing, slitting and perforating steps during collation. The final collated assembly may, for example, be folded in a zig-zag fashion for delivery to a customer. The mailers when still connected may be run at speed through a computer printer before final separation.

However, the webs employed in the construction of the outer envelope and free inserts are normally of substantially the same width. This means that the inserts must comprise either single sheets, or single sheets attached together in a further glueing step as in the case of an inserted return envelope, of no greater width than the outer webs comprising the envelope proper. In other words, it has not been attempted to include a folded insert sheet of say twice the width of the outer plies in its unfolded condition, since this would involve the introduction of a web of substantially different width out of register with the other plies and necessarily involves a difficult folding operation. Nevertheless, the advantages of such an insert must be evident; a four-page form, promotional sheet or brochure can be printed on two sides of a single web; a folded insert is easier to read and allows more flexible graphic layout design on the side opened out; opening a folded insert to lie flat is possible, whereas two sheets placed one above the other and glued along one side are difficult to open out and to lie flat and may become detached; a folded insert designed as a brochure has a better appearance and does not have the feel and look of a business form.

DISCLOSURE OF THE INVENTION

An object of the present invention is therefore to provide a free-insert mailer including a folded insert. A further object is to provide a process and apparatus for constructing a free-insert mailer assembly including a folded insert.

Accordingly the present invention provides a separable multiple ply envelope assembly comprising superimposed outer plies adhered together at their peripheral edges so as to form an envelope and including at least one extractable insert sheet formed from a respective inner ply, and a removable tear-off stub portion along at least one side or face of the assembly to which a corresponding side of the envelope and the insert are both attached, characterized in that the insert sheet is folded prior to its insertion between, and adherence together of, the outer plies.

The insert sheet is preferably longitudinally folded once about a pre-formed score line in the said inner ply. A plurality of insert sheets may be superimposed and folded together and optionally attached together by glueing along one side of the score line, or hinge line. For example, six folded sheets may be superimposed and glued together along a hinge line to form a 24-page insert booklet.

The present invention also provides a process for constructing a separable multiple ply envelope assembly comprising superimposed outer plies adhered together at their peripheral edges so as to form an envelope and including at least one extractible insert sheet formed from a respective inner ply, and a removable tear-off stub portion along at least one side or face of the assembly to which a corresponding side of the envelope and the insert are both attached characterized by steps including:

a) advancing a first web having a first width from an unwind station to a sprocket feed guide means of corresponding width, b) further advancing the first web to a chipping station where cutting die means cut out a series of successive free sections of the web to define said insert sheets, which web is then guided only by one side of the sprocket feed guide means, c) further advancing the first web in this manner to a folding means, suitably comprising a flat fold bed arranged adjacent to one part of the web and a fold guide arranged so as to twist another part of the web progressively downstream so as to lie directly over and above the fold bed, thereby to guide and progressively fold the first web through about 180° about a longitudinal fold line, d) further advancing the folded first web in between front and back outer webs aligned with said sprocket feed guide means, e) subjecting the superimposed webs to a cross-glueing step to adhere the front and back outer webs together at locations in between the free sections of the first web, f) subjecting the superimposed webs to subsequent drying and cross-cutting steps before removing the final assembly from the feed guide means for folding.

The longitudinal fold line is preferably pre-scored onto the first web during an earlier process.

The fold bed may comprise a stationary fold plate arranged in a horizontal plane.

The fold guide may comprise a plurality of parallel guide fingers laterally-offset to one side of, and in a plane parallel to, the fold plate, but twisted progressively out of that plane in a single twist running downstream so as to lie directly over and above the fold plate. The fingers are preferably made of a flexible material and adapted for adjustability in the degree of twist, and width adjustability with respect to the sprocket feed guide means.

Alternatively, the fold guide may comprise a first belt laterally offset to one side of, and in a plane parallel to, the fold bed, but twisted progressively out of that plane in a single twist running downstream so as to lie directly over and above the fold bed. The fold bed in this instance is preferably substituted by a second belt arranged in a substantially horizontal plane. Both first and second belts are advantageously arranged to travel at the same speed as the web, thereby minimizing frictional drag on the web as it passes over and between the belts.

Following step c), the folded first web is preferably subjected to a subsequent pressing step along the line of the fold, for example by means of a nip wheel co-acting against a press roller. Front and back outer webs having a second width are advantageously introduced at step d) from a second unwind station to be taken up by sprocket feed guide means downstream of the folding means being of substantially lesser width than the sprocket feed guide means of step a). The advantage of such an arrangement includes a space saving, in that the front and back outer webs would otherwise have to be temporarily diverted away from the insert web(s) while these pass through the chipping station at step b), were the front and back webs to be introduced at the beginning of the process.

DETAILED DESCRIPTION OF EMBODIMENTS OF THE INVENTION

Figure 1:
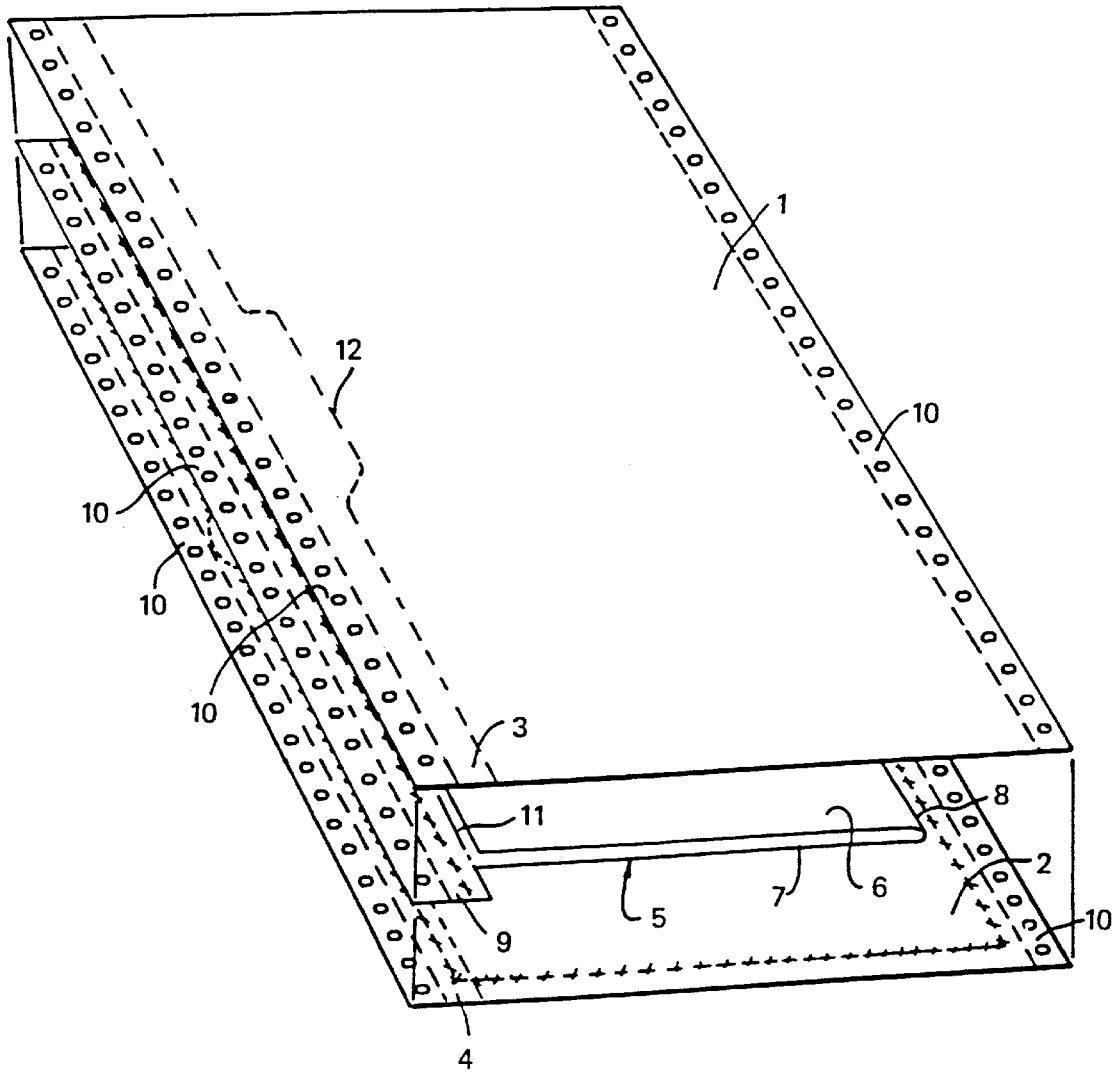
FIG. 1 is an exploded perspective view of a mailer with a single sheet folded free insert in accordance with a first embodiment of the invention.

FIG. 1 shows the most basic mailer construction in accordance with a first embodiment of the invention comprising an envelope front 1, an envelope back 2, a front stub margin 3, a back stub margin 4, a folded free insert sheet 5 comprising front and back leaves 6, 7 and a fold line 8 and an insert stub margin 9. Sprocket margins 10 are common to all sheets 1, 2 and 5. Length-related die cut slits 11 enable the stub margins 3, 4 and 9 to be removed together, cleanly, and thumb notch 12 enables the folded insert 5 to be withdrawn from the envelope when opened. It will be noted that only the back leaf 7 of the folded insert is actually joined to the stub margin 9, but that there need only be a very small difference in the width of the leaves 6,7 when the folded insert is separated from the stub margin and removed, i.e. it may not be noticeable in practice that the two outer side edges of the folded insert do not coincide exactly. The die cut slits 11 produce clean outer side edges, and may for example have only three ties between the slits holding the folded insert to the stub margin prior to separation.

Figure 2:
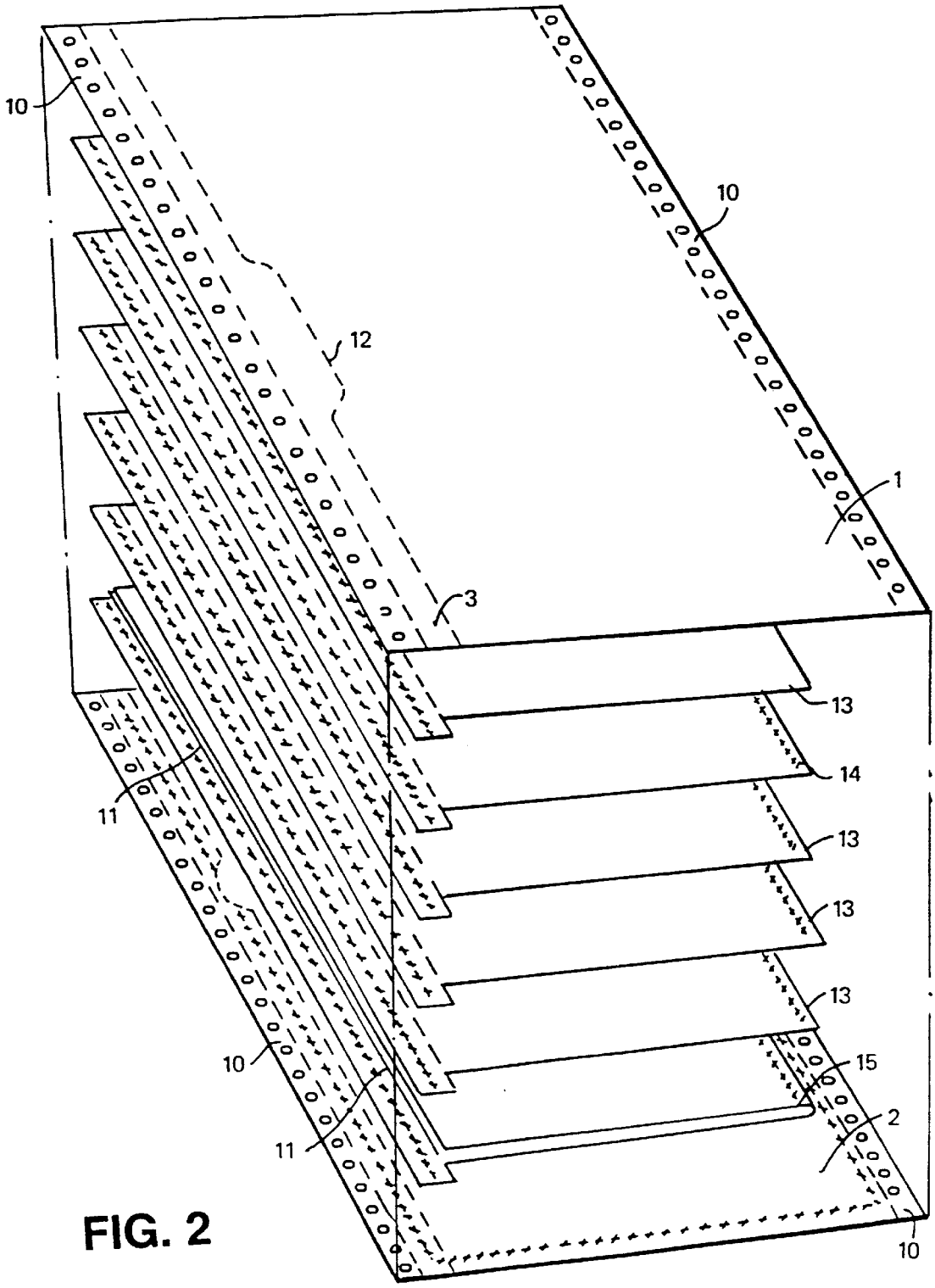
FIG. 2 is an exploded perspective view of a mailer with multiple sheet free inserts including free sheets and a folded sheet in accordance with a second embodiment of the invention.

FIG. 2 shows an alternative mailer construction in accordance with another embodiment of the invention. It is similar to the embodiment illustrated in FIG. 1, except that several plain insert sheets 13, joined together by glue lines 14 are included on top of (or inside) the folded sheet 15. It will be appreciated that various different combinations of plain free inserts, inserts with tear-off sections, and folded free inserts are possible according to the particular application.

Figure 3:
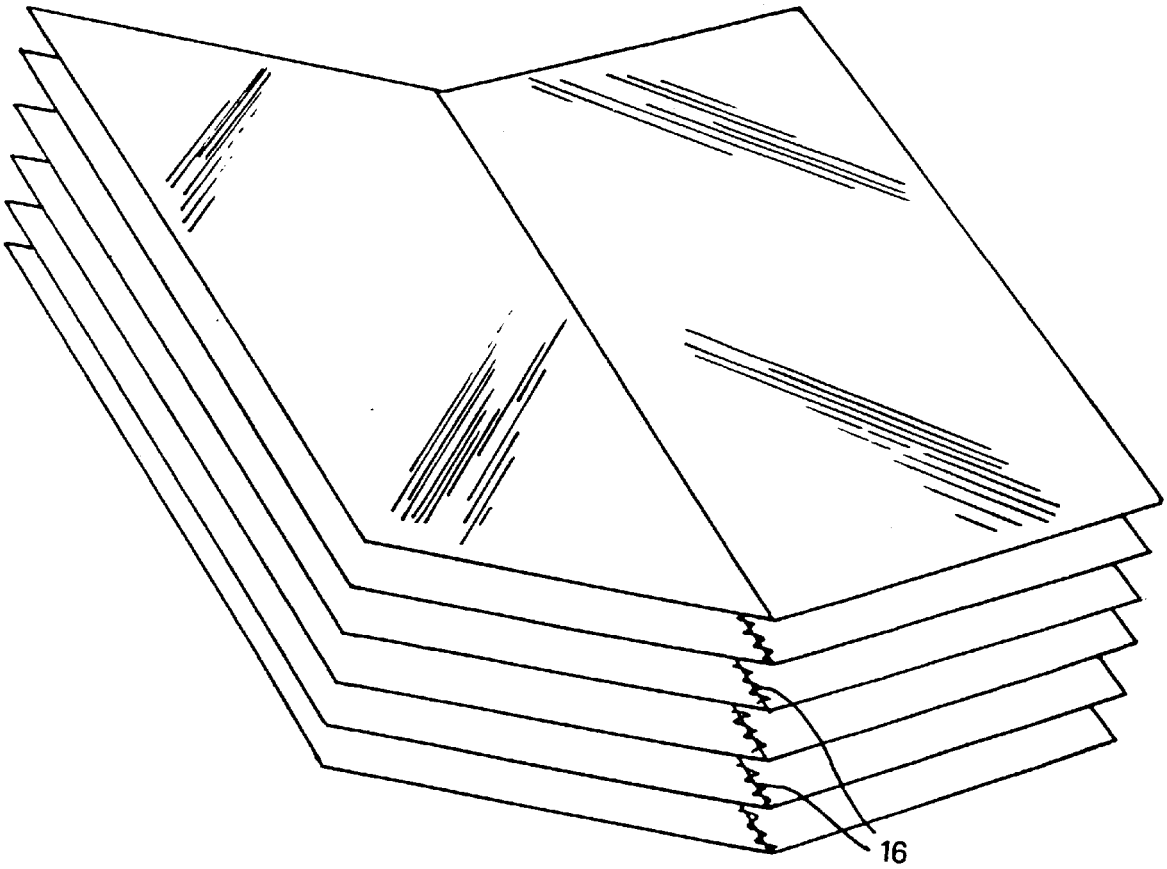
FIG. 3 is a sketch to show a method of glueing together a multiple sheet folded free insert in accordance with a third embodiment of the invention.
Figure 4:
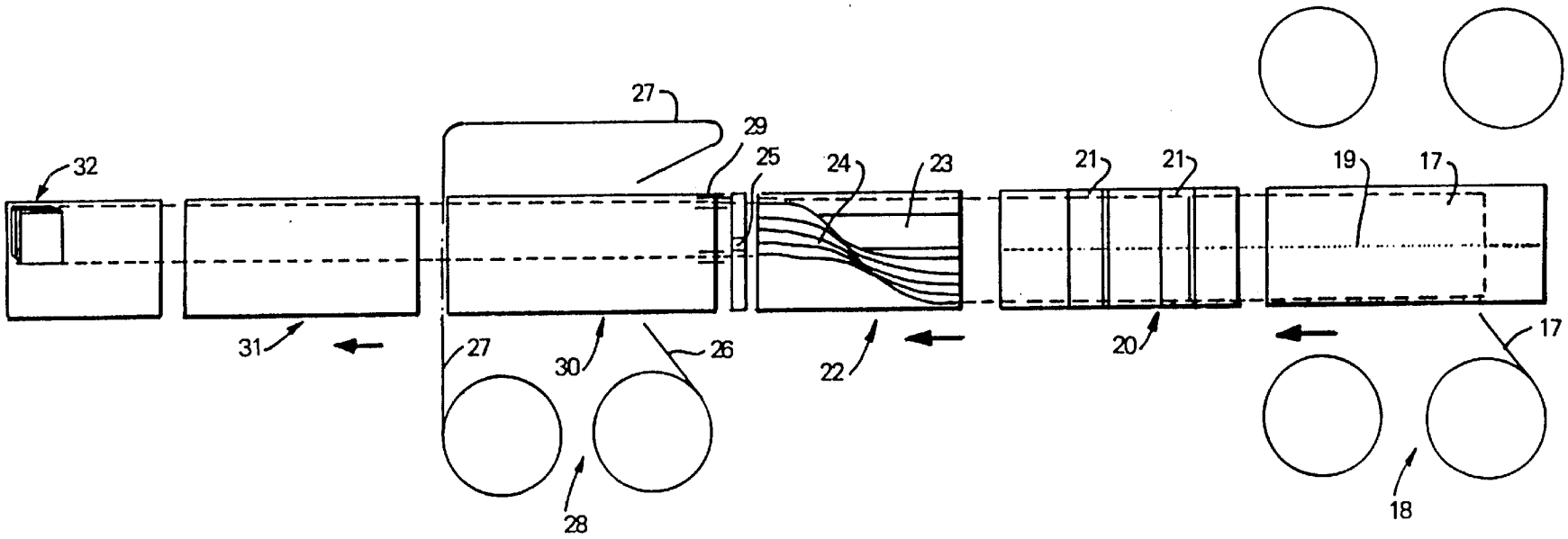
FIG. 4 is a schematic plan view of a production line for use in a process for producing a mailer in accordance with the invention.

FIG. 3 shows a method of constructing a multi-page brochure or booklet as a folded free insert, in this instance made from six webs superimposed and folded together by means of a single folding device, to produce a 24-page booklet. Line glue is applied to five of the sheets at 16 along the hinge or score line so that the sheets are attached together when folded. A process and apparatus for constructing a basic mailer with a folded free insert as shown in FIG. 1 will be described with reference to FIGS. 4 to 6.

A first web of paper 17 is fed from an unwind station 18 comprising pre-printed rolls ready for production and pre-scored with a medial score line 19, onto a sprocket feed guide which engages sprocket hole margins 10 on the web (see FIG. 1). The web 17 is advanced to a chipping station 20 comprising die-cutting cylinders 21 for cutting out transverse and longitudinal sections of the web at intervals to create a series of successive sections of the web joined only to a margin portion of the web along one side of the sprocket feed but this is sufficient to advance the web.

At this stage the web 17 is advanced through a table folder 22, comprising a flat fold plate 23 and a series of parallel guide fingers 24, twisted in a manner which is best described by reference to FIG. 5. The guide fingers 24 lie firstly to one side of the flat fold plate 23, the web 17 passing between these two. The fingers 24 are then twisted out of the plane of the fold plate 23 progressively downstream so as to lie directly over and above the fold plate 23, thus folding the web 17 in half about the score line 19 and in effect reducing the width of the web by half. A nip wheel 25 (see FIG. 4.) bearing on the folded web and against a press roller underneath then presses the fold.

At this stage, front and back webs 26,27 are introduced above and below the folded web 17 from unwind station 28 so as to align with sprocket feed guide wheels 29 which are set at a width approximately half the width of web 17.

Cross perforations and line perforations are effected as appropriate and need not be described.

The superimposed webs 17, 26, 27 are then subjected to a cross-glueing and line-glueing step at 30, and a drying station at 31, before coming off the sprocket guide and folded zig-zag fashion at 32.

Figure 5:
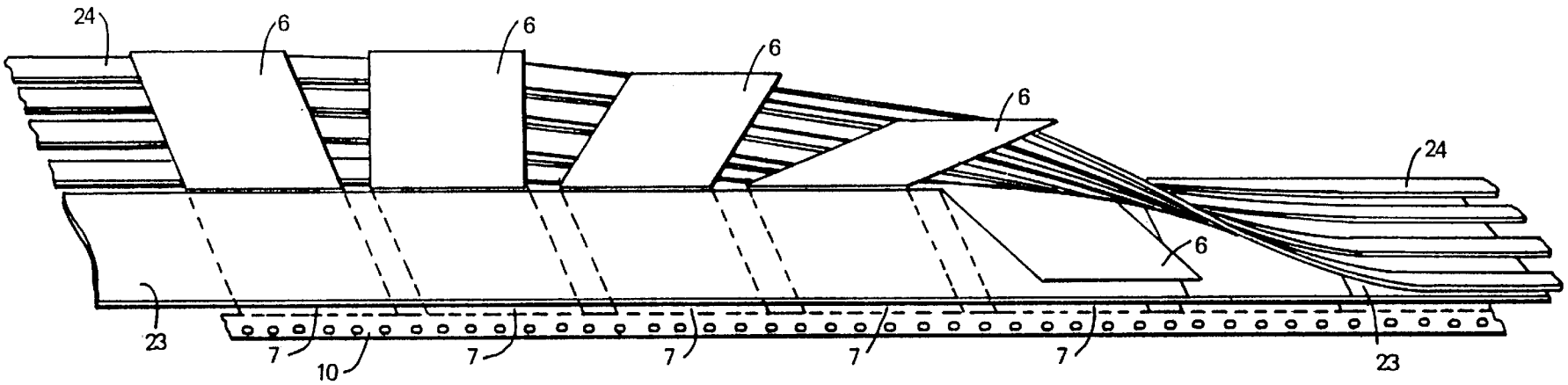
FIG. 5 is a sketch of a folding means employed in that part of the process of constructing a folded free insert.
Figure 6:
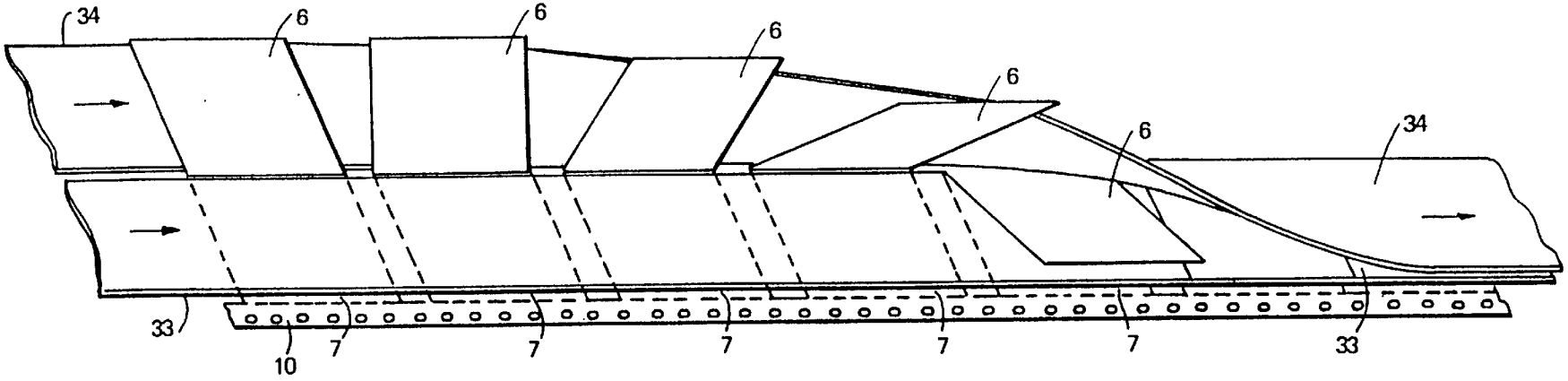
FIG. 6 is a sketch of an alternative folding means employed in that part of the process of constructing a folded free insert.

FIG. 6 shows an alternative folding mechanism, which is very similar to the arrangement shown in FIG. 5, except that the stationary fold plate 23 is substituted with a moving belt 33, and the stationary guide fingers 24 are substituted by a moving belt 34 incorporating a twist. The two belts 33,34 are preferably arranged to move at the same speed as the web is advancing so as to make physical contact with the web but avoid even the slightest frictional drag effects inherent in the stationary fold guides 23,24. The moving belt arrangement therefore has a lesser tendency for snagging or catching of the advancing web as it is being folded. Belt tension and speed can more easily be adjusted, and furthermore the degree of twist in belt 34 can more readily be altered, for fine adjustment of the folding step. All of these features result in potentially less down time during a production run.

I claim:

1. A process for constructing a multiple ply envelope assembly separable from a web comprising superimposed outer plies and at least one inner ply so as to form an envelope, said at least one inner ply forming at least one extractible insert sheet of greater width than the outer plies and folded longitudinally relative to said web, the assembly including a removable tear-off stub portion along at least one side or face of the assembly to which a corresponding side of the envelope and the insert are both attached, such that when removed, the folded insert sheet is freed for extraction from the envelope, said process comprising the steps of:

(a) advancing a first web having a first width from an unwind station to a sprocket feed guide means of corresponding width, and thence to a chipping station, (b) cutting out a series of successive free sections of said first web with die cutting means to define said insert sheets still attached along one side margin of said first web, which said web is then advanced by said side margin with the sprocket feed guide means;

(c) further advancing said first web by said side margin with the sprocket feed guide means to a folding means comprising a first folding guide arranged adjacent to one side of said web and a second folding guide arranged adjacent to the opposite side of said web in such a manner so as to twist part of said web to be folded progressively downstream so as to lie directly over and above an unfolded part of said first web, thereby to guide and progressively fold said first web through about 180° about a medial fold line half-way across said first web and wherein said first web is folded in half, wherein step (c) further comprises using a first folding guide comprising a stationary fold table arranged in a horizontal plane, and a stationary second folding guide comprising a plurality of stationary parallel guide fingers laterally offset to one side of, and in a plane parallel to, the fold table at a first end thereof, but twisted progressively out of that plane in a single twist running downstream so as to lie directly over and above the fold bed at a second end thereof;

(d) further advancing said folded first web in between front and back outer webs aligned with said sprocket feed guide means, as superimposed webs;

(e) subjecting the superimposed webs to a cross-gluing step to adhere the front and back outer webs together at locations in between the said free sections of the first web; and (f) subjecting the superimposed webs to subsequent drying and cross-cutting steps before removing the final assembly from the sprocket feed guide means.

2. A process according to claim 1, using fingers made of a flexible material and adapted for adjustability in the degree of twist, and adapted for width adjustability with respect to the sprocket feed guide means.

3. A process for constructing a multiple ply envelope assembly separable from a web comprising superposed outer plies and at least one inner ply so as to form an envelope, said at least one inner ply forming at least one extractible insert sheet of greater width than the outer plies and folded longitudinally relative to said web, the assembly including a removeable tear-off stub portion along at least one side or face of the assembly to which a corresponding side of the envelope and the insert are both attached, such that when removed, the folded insert sheet is freed for extraction from the envelope, said process comprising the steps of:

(a) advancing a first web having a first width from an unwind station to a sprocket feed guide means of corresponding width, and thence to a chipping station;

(b) cutting out a series of successive free sections of said first web with a die cutting means to define said insert sheets still attached along one side margin of said first web, which said web is then advanced by said side margin with the sprocket feed guide means;

(c) further advancing said first web by said side margin with the sprocket feed guide means to a folding means comprising a first folding guide arranged adjacent to one side of said web and a second folding guide arranged adjacent to the opposite side of said web in such a manner so as to twist part of said web to be folded progressively downstream so as to lie directly over and above an unfolded part of said first web, thereby to guide and progressively fold said first web through about 180° about a medial fold line half-way across said first web, and wherein said first web is folded in half, wherein step (c)further comprises using a first folding guide comprising a first moving belt arranged in a substantially horizontal plane, and a second folding guide comprising a second moving belt laterally offset to one side of, and in a plane parallel to, the first folding guide at a first end thereof, but twisted progressively out of that plane in a single twist running downstream so as to lie directly over and above the first folding guide at a second end thereof;

(d) further advancing said folded first web in between front and back outer webs aligned with said sprocket feed guide means, as superimposed webs;

(e) subjecting the superimposed webs to a cross-gluing step to adhere the front and back outer webs together at locations in between the said free sections of the first web; and (f) subjecting the superimposed webs to subsequent drying and cross-cutting steps before removing the final assembly from the sprocket feed guide means.

4. A process according to claim 3, wherein both first and second belts are arranged to travel at the same speed as the web, thereby minimizing frictional drag on the web as it passes over and between said belts.

* * * * *